United States Patent [19]

Heijting

[11] 4,106,655

[45] Aug. 15, 1978

[54] CONTAINER HAVING A MOUTH, SUCH CONTAINER PROVIDED WITH A METAL CAP AND METAL CAP FOR CLOSING SUCH CONTAINER

[75] Inventor: Hendrik Gerrit Heijting, Deventer, Netherlands

[73] Assignee: Thomassen en Drijver-Verblifa N.V., Deventer, Netherlands

[21] Appl. No.: 724,078

[22] Filed: Sep. 16, 1976

[30] Foreign Application Priority Data

Sep. 17, 1975 [NL] Netherlands ..... 7503162

[51] Int. Cl.[2] ..... B65D 53/00

[52] U.S. Cl. ..... 214/341

[58] Field of Search ..... 215/276, 341

[56] References Cited

U.S. PATENT DOCUMENTS

| | | | |
|---|---|---|---|
| 1,134,069 | 3/1915 | White | 215/276 |
| 1,713,858 | 5/1929 | Tevander | 215/341 |

FOREIGN PATENT DOCUMENTS

| | | | |
|---|---|---|---|
| 109,089 | 11/1939 | Australia | 215/341 |
| 232,811 | 3/1959 | Australia | 215/341 |
| 533,845 | 12/1954 | Belgium | 215/341 |
| 1,364,314 | 5/1964 | France | 215/341 |

*Primary Examiner*—Ro E. Hart

*Attorney, Agent, or Firm*—Charles E. Brown

[57] ABSTRACT

The invention relates to the combination of a container and a cap for closing that container, the container having a mouth, the upper surface of which defining a practically flat plane, and being provided with an upstanding rim extending along the entire perifery, the cap having an upper panel and a sealing channel filled with sealant surrounding this panel, the inner diameter of said channel being smaller than the inner diameter of the rim and larger than the inner diameter of the upper surface of the mouth of the container, while the depth of the sealing channel is in excess of the height of the rim over said upper surface of the mouth.

9 Claims, 3 Drawing Figures

Figure 1A:
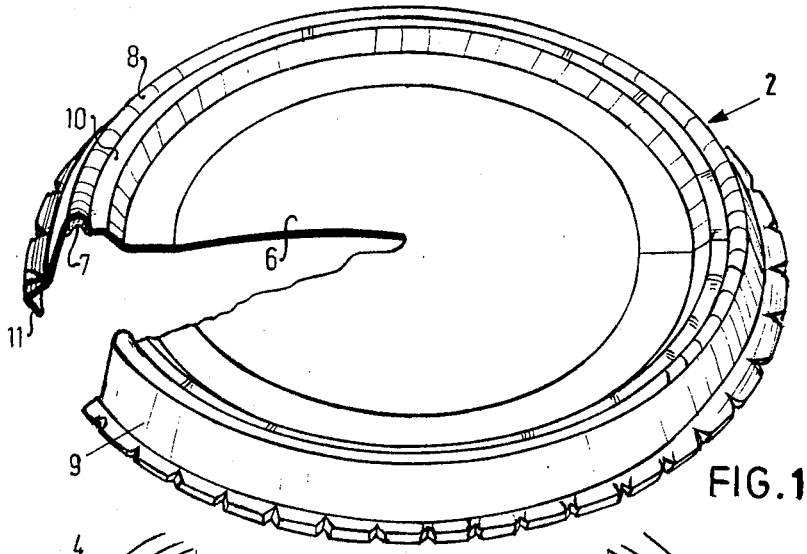

CONTAINER HAVING A MOUTH, SUCH CONTAINER PROVIDED WITH A METAL CAP AND METAL CAP FOR CLOSING SUCH CONTAINER

The invention relates to a container having a mouth, the rim of which having an upper surface defining a practically flat plane. A container of this type is adapted to be sealed by a cap having an upper panel, a sealing channel surrounding this panel filled with a sealing compound and a depending skirt adjoining the channel. The radial width of the sealing channel has to be in excess of the radial width of the upper surface of the mouth rim in order to obtain a suitable sealing. When closing the container with a cap of this type, the cap is fastened by means of from the depending skirt inwardly protuding fastening means such as screw threads and particularly by inward, regularly about the circumference distributed protusions in the depending skirt. The said inward protusions or fastening means are fastened below outward protusions arranged on the outside of the mouth, such as a continuous collar or complementary screw threads.

If a relatively high external pressure is exerted on the cap the original shape of the elastic seal, which inevitably will show some flow, will not sufficiently recover after the pressure has been removed and accordingly the mechanical fastening is imperfect. This phenomenon will particularly occur when the contents of the container are pasteurized or sterilized by a heat treatment under increased pressure.

If the upper rim of the mouth is designed rather narrow, it is even possible that said rim will be pressed through the seal. For different shapes of containers and different processing temperatures and pressures accordingly specially adapted seals are used. Thereby the drawbacks are indeed decreased but not obviated.

The invention provides for a remedy for this problem by providing the container of the type as described with a continuous rim on the upper surface of the mouth and extending along the entire perifery. A container of this type can be sealed by using a cap having an upper panel, a sealing channel surrounding this panel and being filled with a sealing compound, and a depending skirt adjoining the channel. The inner diameter of the sealing channel has to be smaller than the inner diameter of the rim, but larger than the inner diameter of the upper surface of the mouth, while the depth of the sealing channel has to be in excess of the height of the rim over said upper surface of the mouth. Then a sterilization or pasteurization treatment can be effected without damaging the seal of detrimenting the mechanical fastening.

The cap being applied on the container practically bears with its flat part adjoining the sealing channel on the upper surface of the mouth inside the rim. When increased pressures are exerted on the cap the sealing compound is not or only slightly further loaded. Accordingly flow of the sealing is prevented and a perfect seal is maintained.

The construction according to the invention has the additional advantage that solid parts of the contents of the container, such as vegetables and fruit, during the closing and sealing process are better cut by the rim than by the known construction. Moreover the same sealing compound can be used for whichever purpose and as a considerably narrower sealing channel is used, only a fraction of the previously required amount of the sealing compound is required now.

In order to obtain a reliable support of the cap on the mouth preferably the radial width of the rim amounts to 1/5 to ½ of the radial width of the entire upper surface of the mouth; particularly the radial width of the rim is from 1 to 3 mm. The radial width of the sealing channel is in excess of the radial width of the rim though smaller than the radial width of the upper part of the mouth.

Finally the invention relates to a cap having an upper panel, a sealing channel surrounding this panel and being filled with a sealing compound, and a depending skirt adjoining the channel and being distinguished over the known caps of this kind in that the sealing channel has a width comprised between 1,5 and 4 mm and is with its inner perifery directly adjoining a flat part of the upper panel.

Preferably the sealing channel, being in radial section about arc shaped in a preferred embodiments, flowingly merges into the depending skirt at the outer perifery, whereas it at the inner perifery abruptly is connected to the adjoining flat part of the panel. With this design an advantageous transfer of forces and a reliable sealing pressure are obtained.

Figure 1B:
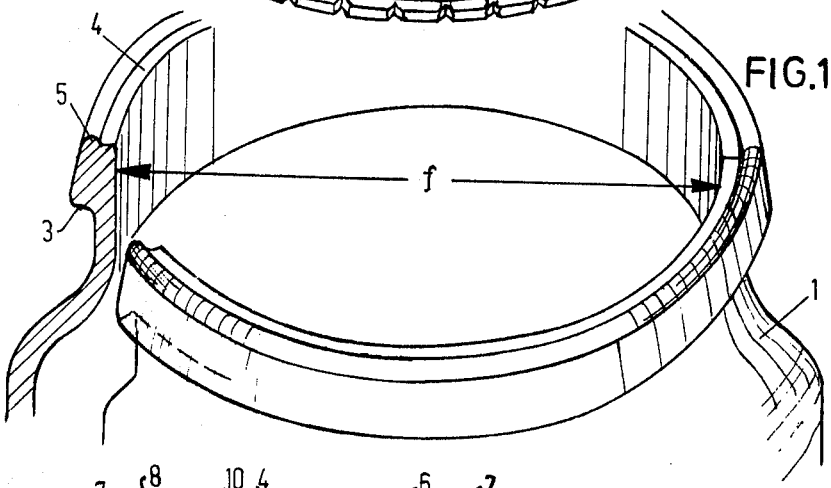
Figure 2:
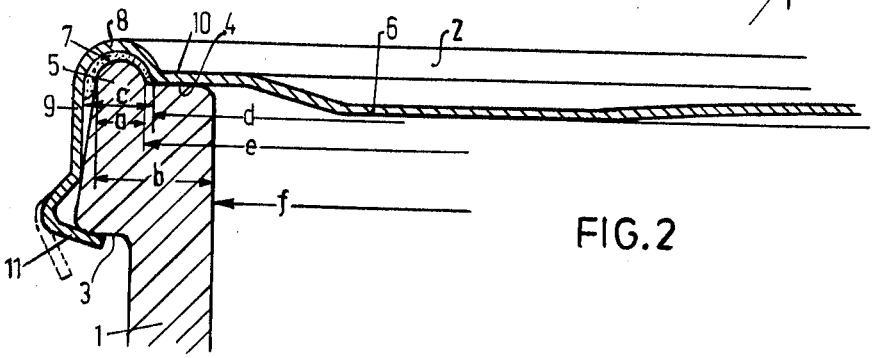

The invention will be elucidated in the following description of a preferred embodiment in conjunction with the accompanying drawing, wherein FIGS. 1A and 1B are a perspective view, partly sectioned, of the upper part of a container and a cap for closing it, FIG. 2 is a sectional view of a part of a sealed container.

In FIG. 1A–B a mouth of a glass jar 1, such as for preserving vegetables and fruit, and a cap 2 for sealing said jar are shown. The shape of the jar is not critical and the mouth opening may be both narrow and wide. The mouth presents at its outer surface as usually a collar 3 for fastening the cap 2 and has at its upper side a flat surface 4, a periferal upstanding rim 5 being provided on said surface adjacent the outer edge thereof. In radial section the rim 5 is about arc shaped. The radial width a of the rim 5 is for jars of commonly used dimensions about ½ to 1/5 of the radial width b of the entire upper surface of the mouth in order that a sufficiently wide supporting surface for the cap 2 remains (see FIG. 2). A suitable radial width a of the rim is from 1 to 3 mm.

The jar 1 can be sealed with a metal cap 2, having an upper panel 6 showing a usual profile, though being practically flat, a sealing channel 8, filled with sealing compound 7 and being adjacent the outer perifery of the panel 6, and a depending skirt 9 adjoining the channel at its outer periphery.

The sealing channel 8 is at its inner periphery contiguous to the flat annular portion 10 of the upper panel 6. After the cap has been provided on the jar the annular portion 10 will practically rest on the upper surface 4 of the mouth. The dimensions of the sealing channel 8, of the rim 5 and of the flat portions of the mouth and the cap, 4 and 10 respectively, have to be suitably chosen: the inner diameter d of the sealing channel 8 is smaller than the inner diameter e of the rim 5 and larger than the inner diameter *f* of the upper surface 4 of the mouth; the radial width c of the sealing channel is in excess of the radial width a of the rim 5 though smaller than the total radial width b of the upper part of the mouth. In practice the radial width of the sealing channel 8 will be from 1,5 to 4 mm.

When the jar 1 is closed with the cap 2, the bead 11 being initially about circular in section, is locally flattened as indicated in broken lines in FIGS. 1A and 2. Thereby the cap is fastened below the collar 3, extending around the mouth. As during this closing procedure a downward pressure is exerted on the cap the rim 5 is pressed into the sealing compound 7. The annular portion 10 of the cap 2 limits the downward movement of the cap by abutment against the upper surface 4 of the mouth both during the closing procedure and the sterilizing or pasteurizing treatment when again a considerable pressure is exerted on the cap.

The invention is applicable both to ventilating and non-ventilating closures, while it does not need any elucidation that other fastening means than those depicted in the drawings and described in the specification can be used.

What I claim is:

1. A combination of a container and a closure cap; said container having a mouth internally defined by a substantially planar upwardly facing seating surface; an upstanding rim dispersed radially outwardly and axially upwardly of said seating surface, and cap retaining abutment means spaced axially downwardly from said rim; said closure cap having a central panel, downwardly opening a sealing channel surrounding said central panel, a skirt extending down from said sealing channel, said sealing channel having a deformable sealing material therein, and said skirt having retaining means; and said closure cap being seated on said container in mouth sealing relation with said retaining means engaging said abutment means and urging said sealing channel down over said rim with said sealing material being deformed around said rim and deformation of said sealing material being limited by the seating of said central panel on said seating surface.

2. The combination of claim 1, characterized in that the radial width of the rim amounts to only 1/5 to ½ of the radial width of the entire upper surface of the mouth.

3. The combination of claim 2, characterized in that the radial width of the rim is from 1 to 3 mm.

4. The combination of claim 1, characterized in that the rim is semicircular in radial section.

5. The combination of claim 1 wherein said container axially below said rim extends radially outwardly of said rim, and said sealing material is in part disposed radially outwardly of said rim.

6. The combination of claim 1 wherein said container axially below said rim extends radially outwardly of said rim, and said sealing material is in part disposed radially outwardly of said rim and axially below said rim.

7. The combination of claim 1 wherein said sealing channel joins said central panel in inwardly radially spaced relation to said rim, and said sealing material being disposed radially inwardly of said rim.

8. The combination of claim 7 wherein said sealing channel terminates abruptly into said central panel generally at right angles thereto.

9. The combination of claim 1 wherein said sealing channel joins said central panel in inwardly radially spaced relation to said rim, and said sealing material being disposed radially inwardly of said rim and down to said seating surface.

* * * * *